United States Patent [19]

Takano et al.

[11] Patent Number: 4,694,762

[45] Date of Patent: Sep. 22, 1987

[54] SEWING MACHINE CONTROL APPARATUS

[75] Inventors: Kunio Takano, Tokyo; Masanori Nukushina, Kanagawa, both of Japan

[73] Assignee: Tokyo Juki Industrial Co., Ltd., Tokyo, Japan

[21] Appl. No.: 767,292

[22] PCT Filed: Nov. 13, 1984

[86] PCT No.: PCT/JP84/00543

§ 371 Date: Aug. 7, 1985

§ 102(e) Date: Aug. 7, 1985

[87] PCT Pub. No.: WO85/02871

PCT Pub. Date: Jul. 4, 1985

[30] Foreign Application Priority Data

Dec. 26, 1983 [JP] Japan ..... 58-246833

[51] Int. Cl.[4] ..... D05B 21/00

[52] U.S. Cl. ..... 112/121.12

[58] Field of Search ..... 112/121.12, 121.11, 112/275, 277, 453, 456

[56] References Cited

U.S. PATENT DOCUMENTS 4,135,459 1/1979 Manabe et al. ..... 112/275 X 4,582,006 4/1986 Yamane ..... 112/121.12

FOREIGN PATENT DOCUMENTS 54-87367 7/1979 Japan .

57-164089 10/1982 Japan .

*Primary Examiner*—Peter Nerbun

*Attorney, Agent, or Firm*—Wenderoth, Lind & Ponack

[57] ABSTRACT

A sewing machine control apparatus is adapted to move a needle rod to a predetermined stitching starting point automatically when a stitching operation is performed, even if a fabric holding body holding an article to be stitched is displaced relative to the needle rod. The apparatus is equipped with operating means for generating a signal which displaces the fabric holding body in an X-Y direction, second control means responsive to the signal for controlling drive means to move the fabric holding body starting means for generating a signal which starts a driving source of the sewing machine, third control means for storing a signal indicative of the position of the fabric holding body while constantly revising the signal, and fourth control means for controlling the drive means in response to the start signal in such a manner that the fabric holding body is moved from any position to the stitching starting position.

1 Claim, 5 Drawing Figures

SEWING MACHINE CONTROL APPARATUS

FIELD OF THE INVENTION

This invention relates to a sewing machine control apparatus whereby a seam of a predetermined shape is formed while a fabric holding body holding an article to be stitched is moved horizontally relative to a needle rod and then halted.

PRIOR ART

The aforementioned type sewing machines include cycle stitch sewing machines such as lock stitch sewing machines, button hole working sewing machines, button attaching sewing machines and embroidering sewing machines. In particular, a recent electronically controlled sewing machine known in the art is adapted for form a seam of a predetermined shape by coupling a pair of stepping motors to a fabric holding body holding an article to be stitched and controlling the stepping motors on the basis of information stored on an information storage medium such as a floppy disc. When stitching a pattern A→B→C→D of the kind shown in FIG. 4 by the fabric holding body having coordinate axes X, Y and an origin $O_1$, with the conventional electronically controlled sewing machine the needle is moved from an arbitrary point K to a first needle descent point A through the origin $O_1$ and then is brought to a stop. However, since the stopping position is decided by such factors as the shape and size of the pattern to be stitched, a drawback is that the needle occasionally becomes an obstacle to a change or insertion of fabric.

SUMMARY OF THE INVENTION

An object of the present invention is to provide a sewing machine control apparatus adapted to move a fabric holding body to a stitching starting point automatically relative to a needle rod, even if the position of the fabric holding body relative to the needle rod is changed, when the machine performs a stitching operation.

Specifically, in a sewing machine having a needle rod having a needle secured to a lower end thereof and movable up and down in operative association with a main shaft;

a moving body having a fabric holding body to and from which a fabric is capable of being attached and detached, the moving body being freely movably supported on an upper surface of a bed in a plane perpendicular to the direction in which the needle rod moves;

drive means coupled to the moving body in such a manner that the moving body is moved under electrical control in the plane along perpendicularly intersecting X and Y axes individually or along a resultant direction;

memory means for successively storing needle descent position data for each stitching pattern as movement data in the X and Y directions from a stitching starting position to a stitching end position;

means for reading the movement data out of the memory means; and first control means for driving the drive means in relation to the read movement data;

the present invention provides a sewing machine control apparatus characterized by provision of:

operating means for generating a displacement signal which moves the moving body in the X and Y directions;

second control means responsive to the displacement signal for controlling the drive means to move the moving body to a desired position;

starting means for generating a start signal by a manual operation to start a driving source of the sewing machine;

third control means for storing a signal indicative of the position of the fabric holding body, the position signal being revised at all times based on the displacement signal, and fourth control means responding to the generation of the start signal for controlling the drive means in such a manner that the moving body is moved from a position having X and Y coordinates responsive to the revised position signal to a stitching starting position of a stitching pattern.

DETAILED DESCRIPTION OF THE INVENTION

An embodiment of the present invention will now be described with reference to the drawings. Numeral 1 denotes the main body of a lock stitching sewing machine, 2 a bed, and 3 a needle rod having a needle 4 secured to its lower end and moved up and down in operative association with a main shaft (not shown). Numeral 5 designates a moving body having a base end coupled to a pair of stepping motors XM, YM (FIG. 2) so as to be moved in X and Y directions by an arrangement disclosed in, e.g., the publication of Japanese Patent Application Laid-Open No. 57-55177, and a distal end to which a generally rectangular fabric holding body 6, which is capable of holding a fabric, is secured in such a manner that a needle descent point is situated within the rectangle.

Situated on the front side of the sewing machine body 1 are a start switch SW, a ready switch RW, and a keyboard KB for designating the pattern to be selected and for entering the enlargement or reduction ratio of the pattern, and the like. JSW denotes a jog switch comprising an up switch $S_1$, a left switch $S_2$, a down switch $S_3$, and a right switch $S_4$, the operation of which will be described later. These operating members are provided on a control panel 7 detachable from the sewing machine main body 1. The control panel 7 and main body 1 are connected by a cord, which is not shown.

Control circuitry will be described next.

Figure 1:
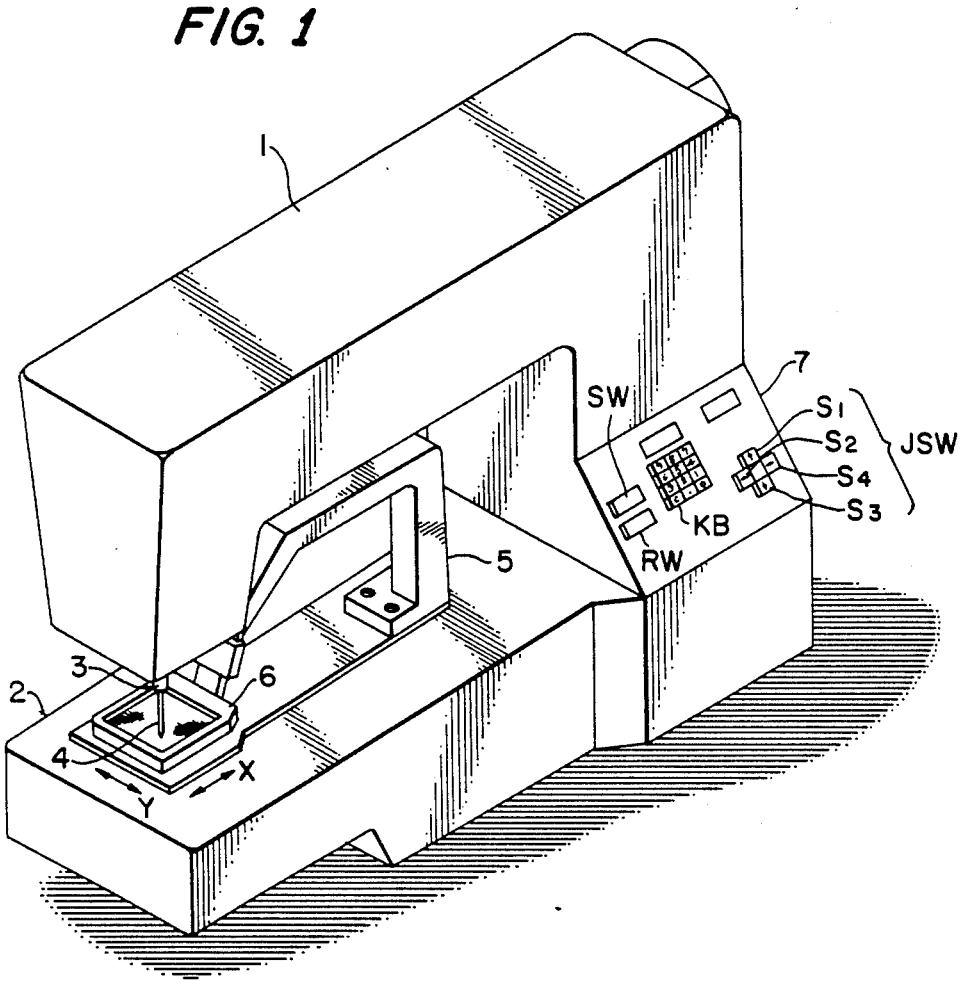
FIG. 1 is a perspective view of a lock stitch sewing machine.
Figure 2:
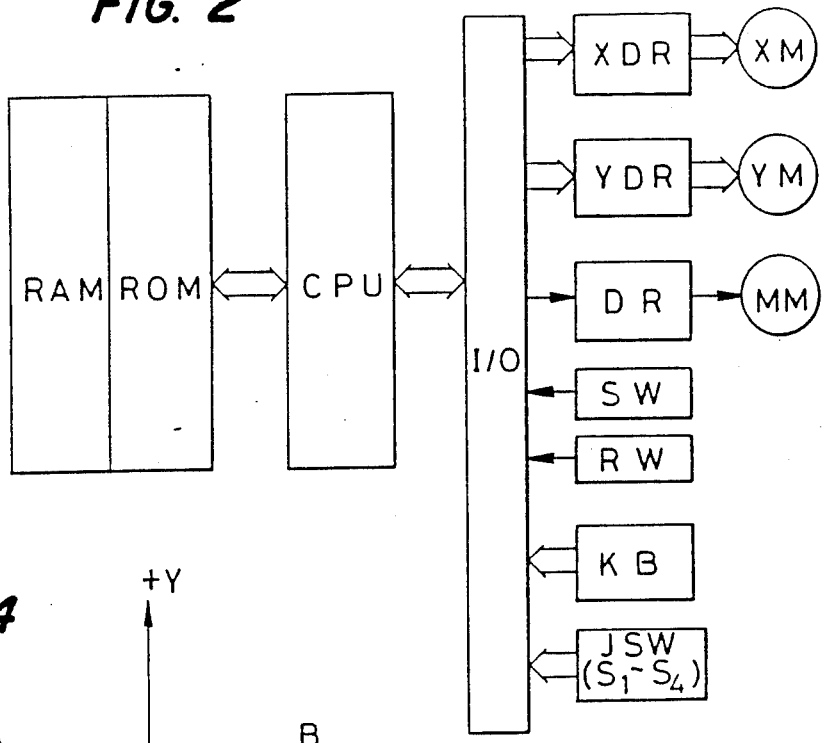
FIG. 2 is a block diagram of a control circuit.
Figure 4:
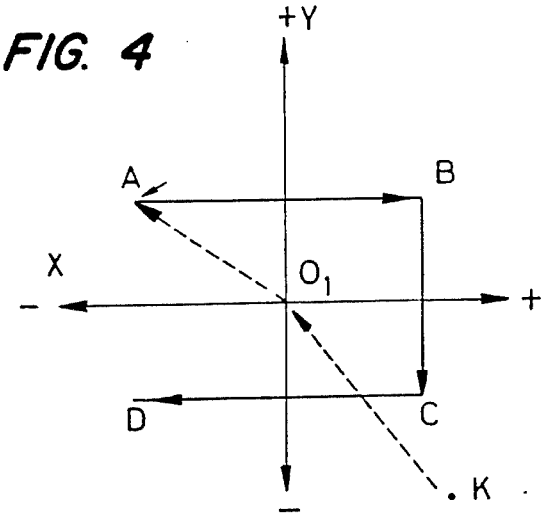
FIG. 4 is a graph showing the positional relationship between a pattern and a second origin in the conventional lock stitch sewing machine.

In FIG. 2, RAM is a random-access memory into which data can be written and from which data can be read at will for temporarily storing data from a floppy disc. ROM represents a read-only memory solely for read-out and stores a program shown in FIG. 3. CPU denotes a central porcessing unit having arithmetic and input/output functions.

XDR, YDR designate drive circuits for the stepping motors XM, YM, respectively, and DR denotes a drive circuit for a motor M coupled to the main shaft. I/O is an interface circuit of the CPU and allows input and output of instructions and signals between the CPU and XDR, YDR, DR, SW, RW, KB, JSW.

Though not shown, a unit for reading data from a floppy disc is also connected to the I/O.

Figure 3:
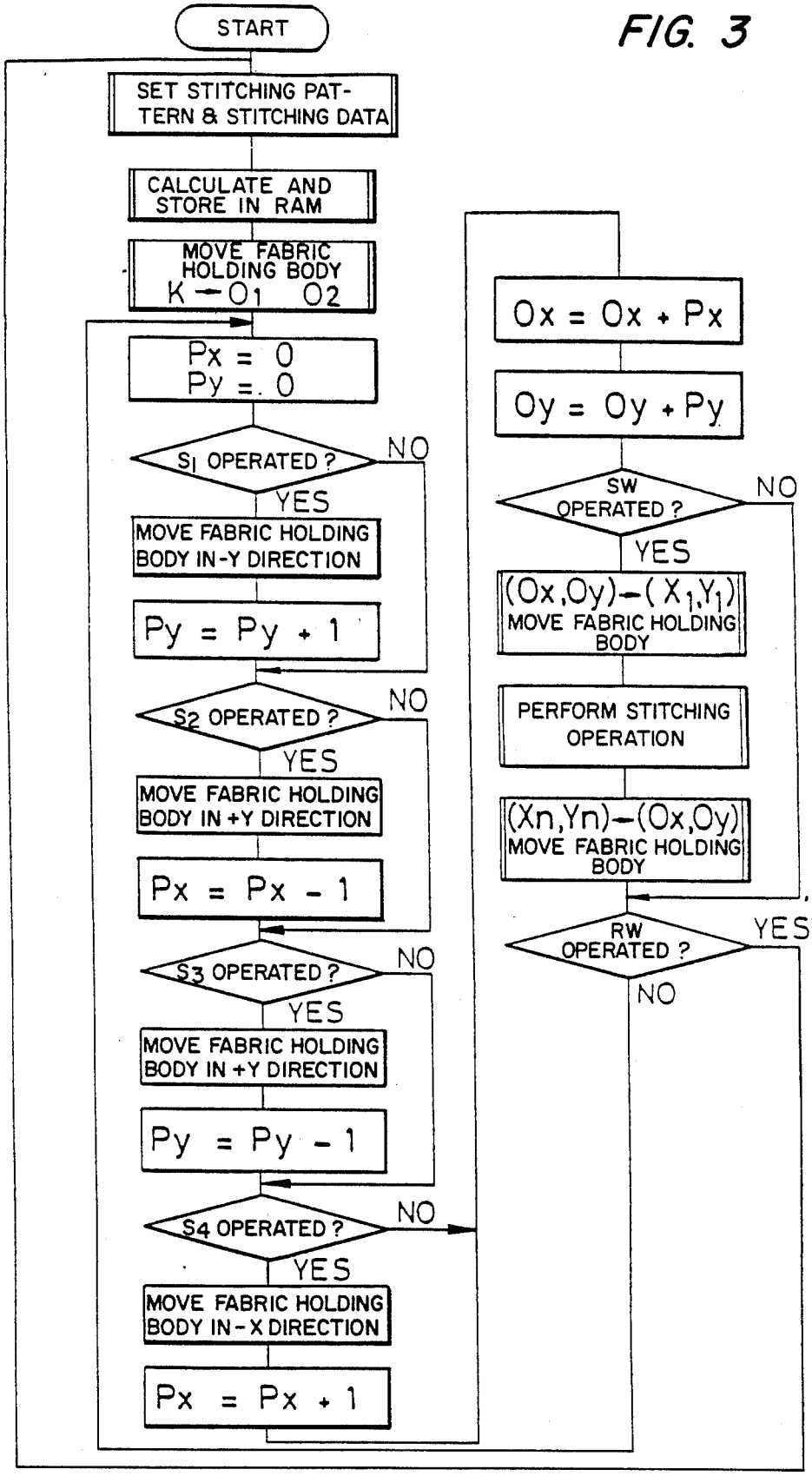
FIG. 3 is a flowchart of a CPU control program.

Described next will be the flowchart of control executed by the control circuitry. In FIG. 3, the first step is to select a pattern and set the enlargement or reduction ratio of the pattern by the keyboard KB in order to start the program. By doing so, a microcomputer inside the sewing machine reads the corresponding pattern data from the floppy disc, the CPU calculates stitching data for every needle with the enlargement or reduction rate serving as a parameter, and the stitching data are successively written into the RAM.

Figure 5:
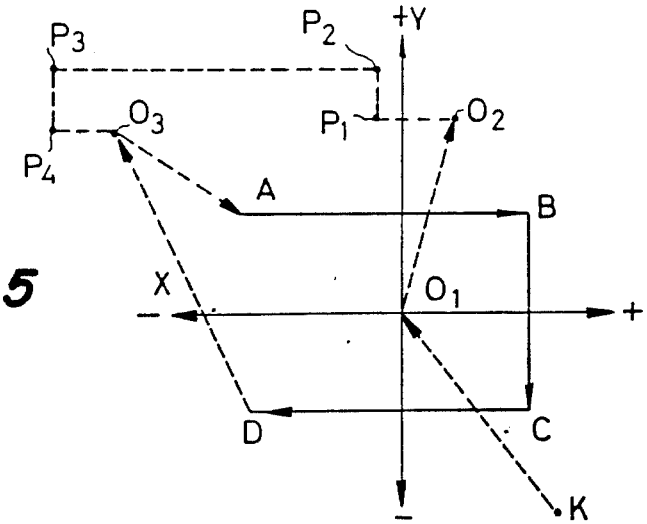
FIG. 5 is a graph illustrating an operation for positionally adjusting the second origin with respect to a pattern in the lock stitch sewing machine of the present invention.

It should be noted that a predetermined second origin $O_2$ different from that of the pattern A-B-C-D shown in FIG. 5 has been previously incorporated as position data in the above-mentioned pattern data.

When the writing of one cycle of stitching data in the RAM ends, the fabric holding body 6 is moved from the currently prevailing needle position K (FIG. 5) to the second origin $O_2$, which is at a predetermined position, through the first origin $O_1$. The reason for the traversal of the first origin $O_1$ at this time is to pre-correct for any maladjustment developed by the stepping motors XM, YM.

At the conclusion of the foregoing operation, the values of movement parameters $P_x$, $P_y$ of the fabric holding body 6 are both reset to "0" and the position of the needle is adjusted by using the jog switch JSW. Specifically, when the up switch $S_1$ is manipulated, the fabric holding body 6 is moved in the $-Y$ direction by an amount equivalent to one pitch (where one pitch is taken as the travelling distance corresponding to a specific number of steps of movement made by stepping motor XM or YM), and the value of $P_y$ is incremented by "1". When the left switch $S_2$ is manipulated, the fabric holding body 6 is moved in the $+X$ direction by an amount equivalent to one pitch and the value of $P_x$ is decremented by "1". When the down switch $S_3$ is manipulated, the fabric holding body 6 is moved in the $+Y$ direction by an amount equivalent to one pitch and the value of $P_y$ is decremented by "1". When the right switch $S_4$ is manipulated, the fabric holding body 6 is moved in the $-X$ direction by an amount equivalent to one pitch and the value of $P_x$ is incremented by "1".

When the input operation made by $S_1$ through $S_4$ of the jog switch JSW are concluded, the values of the parameters $P_x$, $P_y$ calculated owing to operation of $S_1$ through $S_4$ are added respectively to $O_x$, $O_y$, which are the respective X and Y coordinates of the second origin $O_2$, thereby shifting the coordinate values of the second origin $O_2$.

Next, it is determined whether the start switch SW has been operated. When the start switch SW is operated, the fabric holding body 6 is moved from the coordinates ($O_x$, $O_y$) of the displaced second origin to a first needle descent point ($X_1$, $Y_1$) of the pattern and a seam is formed by driving the needle 4 into the fabric while the fabric holding body 6 is moved by the stepping motors XM, YM on the basis of plural items of stitching data ($X_1$, $Y_1$) through ($X_n$, $Y_n$), which have been written into the RAM. Thus, when formation of a seam up to the final needle descent point ($X_n$, $Y_n$) of the pattern ends, the thread leading from the fabric to the needle 4 is severed by a thread cutting device (not shown) provided on the lower side of the bed, the needle rod 3 is raised and stopped, and the fabric holding body 6 is moved from the final needle descent point ($X_n$, $Y_n$) to the corrected second origin ($O_x$, $O_y$).

If the ready switch RW is operated at this time, a return is effected to the pattern selection and pattern enlargement or reduction ratio setting operation performed by the keyboard KB. If the ready switch SW is not manipulated, however, the values of $O_x$, $O_y$ are retained, $P_x$, $P_y$ are set to 0, and a return is effected to the input operation performed by the jog switch JSW.

(Operation)

Following the introduction of power to the sewing machine main body 1, a floppy disc storing a variety of pattern data is loaded into the sewing machine main body 1. The pattern shown in FIG. 5 is selected and an enlargement ratio is set by the keyboard KB. As a result, stitching data are calculated based on both the set pattern data from the floppy disc and the enlargement ratio, and the data are successively stored in the RAM. The coordinates $O_x$, $O_y$ of the second origin $O_2$ are also calculated at this time. When one cycle of stitching data are thus stored in the RAM in their entirety, the stepping motors XM, YM are operated to move the fabric holding body 6 from the current needle position K to the first origin $O_1$ and then to the second origin $O_2$ ($O_x$, $O_y$).

Let us assume here that when it is attempted to mount the fabric in the fabric holder 6, the needle 4 situated at the second origin $O_2$ contacts the operator's fingers and impedes the mounting of the fabric. Accordingly, the operator presses, say, the left switch $S_2$ of the jog switch JSW several times, whereupon the stepping motor XM is driven to move the fabric holding body 6 to the right by a pitch equivalent to the number of times the switch was pressed. Thus, according to the relationship between the pattern A-B-C-D and the needle 4, the latter is moved leftward relative to the pattern A-B-C-D and the value of $P_x$ is decremented ($P_1$) by the number of times the switch is pressed.

Next, the up switch $S_1$ is pressed, whereupon the needle 4 is moved upward ($P_2$), relatively, by drive supplied by the stepping motor YM. Next, when the left switch $S_2$ is pressed, the needle 4 is moved relatively leftward ($P_3$), and when the down switch $S_3$ and right switch $S_4$ are then pressed sequentially, the relative position of the needle 4 moves from $P_3$ to $P_4$ and thence to $O_3$.

Though the position of the second origin $O_2$ ($O_x$, $O_y$) is displaced by these operations, the values of the coordinates ($O_x$, $O_y$) thereof are updated by $O_x=O_x+P_x$, $O_y=O_y+P_y$ each time one of the switches $S_1$ through $S_4$ of the jog switch JSW is pressed. In other words, the updated coordinates ($O_x$, $O_y$) of the second origin $O_2$ are varified by the CPU at all times.

When $O_3$ in FIG. 5 is thus set as the position of a satisfactory second origin ($O_x$, $O_y$), the operator presses the start switch SW. With this done, the amount of movement (traverse mode) and the direction of movement of the fabric holding body 6 are calculated from the coordinates ($O_x$, $O_y$) of $O_3$ and the first needle descent point ($X_1$, $Y_1$) of the stitching data, the fabric holding body 6 is transported to A ($X_1$, $Y_1$) by drive supplied by the stepping motors XM, YM, the stepping motors XM, YM are driven on the basis of the data in the RAM, and the needle 4 is driven into the fabric from A ($X_1$, $Y_1$) to start the stitching operation.

When seam formation progresses from A ($X_1$, $Y_1$) to B then to C and then to D ($X_n$, $Y_n$) to end one cycle of stitching, the fabric holding body 6 returns from D ($X_n$, $Y_n$) to the updated second origin $O_3$ ($O_x$, $O_y$).

If one of the switches $S_1$, $S_2$ of the jog switch JSW is operated, the position of the aforementioned second origin ($O_x$, $O_y$) can be shifted at any time.

Further, when the ready switch RW is pressed, it becomes possible to select a new pattern and to set the enlargement or reduction ratio of the pattern by operating the keyboard KB.

(Advantages of the Invention)

According to the present invention as set forth above, the position of the second origin $O_2$ can be moved with respect to a pattern by operating switches such as the jog switch. Therefore, since the second origin $O_2$ can be moved in accordance with the more skillful arm of the operator, the forming of the shape of the fabric and the configuration of the stitched seam, and the operation of attaching the fabric to and detaching the fabric from the fabric holding body can be facilitated.

In addition, by incrementing or decrementing the predetermined parameters $P_x$, $P_y$ at this time by an amount commensurate with jog switch operation, the CPU constantly monitors the position of the fabric holding body. Accordingly, no matter what position the fabric holding body is moved to by the jog switch, the fabric holding body will be moved to the first needle descent point immediately at the start of stitching and distortion in the pattern of the stitched seam will not occur.

(Other Embodiments)

According to the above-described embodiment, a jog switch is used to effect movement to the second origin $O_2$. However, the invention is not limited to this arrangement, for any switch such as a lever switch or toggle switch may be employed. Alternatively, it would readily occur to one skilled in the art to forgo provision of the jog switch and modify the program to enable movement of the second origin $O_2$ by a specific combination of numerals entered from the keyboard KB.

Further, the present invention is applicable even if the second origin $O_2$ is not placed at a position different from the pattern, e.g., even for patterns where the first needle descent point and $O_2$ coincide. Moreover, a servomotor, linear stepping motor or the like may be used as the means for driving the moving body 5.

In addition, the present invention is obviously not limited to lock stitch machines but can be widely applied to cycle sewing machines such as button attaching sewing machines and button hole sewing machines, to embroidering sewing machines and the like.

While the present invention has been described on the basis of a preferred embodiment thereof, various changes and modifications are possible without departing from the technical scope thereof. Thus, the present invention is to be defined solely by the appended claims and should not be limited to the above embodiment.

We claim:

1. In a sewing machine including a needle rod having a needle secured to a lower end thereof and movable up and down directions in operative association with a main shaft, a moving body having a fabric holding body to and from which a fabric is capable of being attached and detached, said moving body being freely supported on an upper surface of a bed for movement in a plane perpendicular to said direction in which the needle rod moves, drive means coupled to said moving body in such a manner that said moving body is moved under electrical control in said plane along perpendicularly intersecting X and Y axes individually or along a resultant direction, memory means for successively storing needle descent position data for each stitching pattern as movement data in the X and Y directions from a stitching starting position to a stitching end position and for storing a fixed position in the X and Y directions as a first origin, means for reading said movement data out of said memory means, and first control means for driving said drive means in relation to the read movement data, the improvement comprising:

starting means for generating a start signal by a manual operation to start a driving source of the sewing machine;

manual operating means for generating a position signal in the X and Y directions before generation of said start signal;

second control means for controlling said drive means to move said moving body in response to said position signal;

third control means for storing a position in the X and Y direction corresponding to said position signal as a second origin; and fourth control means for controlling said drive means to move said moving body to a stitching starting position of said second origin in response to said start signal and to return said moving body to said second origin after completion of the stitching pattern.

* * * * *